US007529378B2

(12) United States Patent
Roeck et al.

(10) Patent No.: US 7,529,378 B2
(45) Date of Patent: May 5, 2009

(54) FILTER FOR INTERFERING SIGNALS IN HEARING DEVICES

(75) Inventors: Hans-Ueli Roeck, Hombrechtikon (CH); Stefan Daniel Menzl, Jona (CH)

(73) Assignee: Phonak AG, Stafa (CH)

( * ) Notice: Subject to any disclaimer, the term of this patent is extended or adjusted under 35 U.S.C. 154(b) by 366 days.

(21) Appl. No.: 10/987,875

(22) Filed: Nov. 12, 2004

(65) Prior Publication Data

US 2006/0104463 A1 May 18, 2006

(51) Int. Cl.
*H04R 25/00* (2006.01)

(52) U.S. Cl. ..... 381/318; 381/94.1; 381/94.3

(58) Field of Classification Search ..... 381/318, 381/316, 317, 94.1, 94.5, 94.8
See application file for complete search history.

(56) References Cited

U.S. PATENT DOCUMENTS

| | | | | |
|---|---|---|---|---|
| 4,750,207 | A * | 6/1988 | Gebert et al. | 381/317 |
| 6,137,888 | A * | 10/2000 | McClennon et al. | 381/318 |
| 6,269,093 | B1 * | 7/2001 | Alapuranen et al. | 370/343 |
| 6,347,148 | B1 * | 2/2002 | Brennan et al. | 381/318 |
| 6,587,568 | B1 * | 7/2003 | Sigwanz | 381/317 |
| 6,608,904 | B1 * | 8/2003 | Feltstrom | 381/59 |
| 6,850,735 | B2 * | 2/2005 | Sugar et al. | 455/67.11 |
| 6,885,751 | B2 * | 4/2005 | Pribyl | 381/174 |
| 2002/0057814 | A1 * | 5/2002 | Kaulberg | 381/312 |
| 2002/0086641 | A1 * | 7/2002 | Howard | 455/67.1 |
| 2002/0191804 | A1 * | 12/2002 | Luo et al. | 381/312 |
| 2004/0053575 | A1 | 3/2004 | Fungfelder | |
| 2004/0151332 | A1 * | 8/2004 | Danielsen et al. | 381/318 |
| 2005/0063558 | A1 * | 3/2005 | Neumann et al. | 381/317 |
| 2006/0291681 | A1 * | 12/2006 | Klinkby et al. | 381/318 |

FOREIGN PATENT DOCUMENTS

| | | |
|---|---|---|
| EP | 0 843 427 | 3/1998 |
| EP | 0 941 015 | 9/1999 |
| EP | 1 104 645 B | 2/2003 |

OTHER PUBLICATIONS

Kates, Classification of background noises for hearing-aid applications, in 97 Journal of Accoustical Soc'y of Am. 461, 467-68 (Journal of Acoustical Soc'y of Am. 1995) (herein Kates).*

* cited by examiner

*Primary Examiner*—Walter F Briney, III
(74) *Attorney, Agent, or Firm*—Pearne & Gordon LLP

(57) ABSTRACT

In a process for filtering interfering signals, occurring with largely known constant repetition frequency at the use of hearing devices in or at the hearing device the repetition frequency of the interference signal shall be detected and at recognition of the known constant frequency the signal shall be suppressed or damped respectively at the expected next point of time at least partially. The detection can happen for instance via the duty cycle and/or the basic frequency of the interference signal.

16 Claims, 2 Drawing Sheets

FILTER FOR INTERFERING SIGNALS IN HEARING DEVICES

Figure 1:
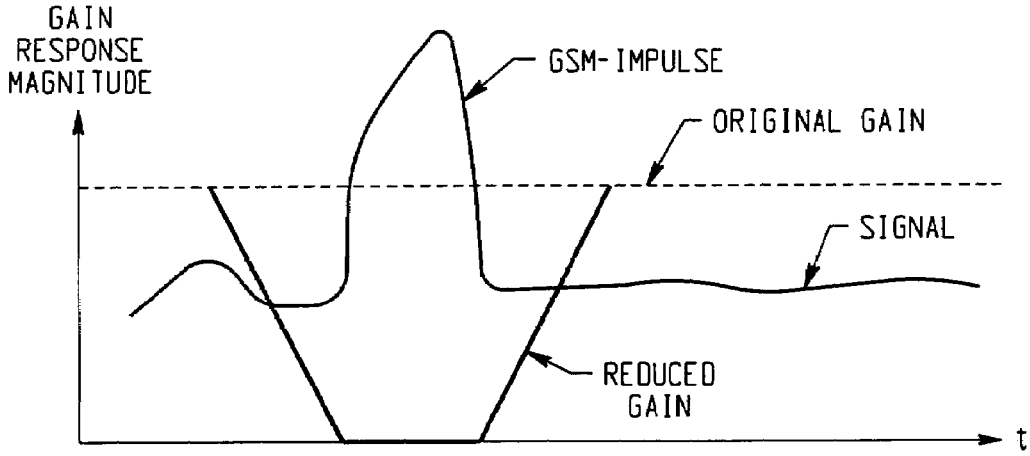

The present invention refers to a process for filtering interfering signals with largely known unchanging repetition rate according the introduction of claim 1 as well as an arrangement for filtering interfering signals.

Filtering of for instance high frequency signals happens in actually known hearing devices exclusively by using an adequate assembly and passive high frequency filters. Thereby it should be achieved that high frequency signals, as they are produced e.g. from a GSM mobile telephone either are not launched and/or kept away by the filtering structure from possible non-linearities within the circuit and therefore are not demodulated.

Solutions as they are proposed within the U.S. Pat. No. 6,205,190 (for CDMA, Code Division Multiple Access) or within the EP 0 876 717 (for GSM, Global System for Mobile communication) operate on the side of the telephone, as they prevent or at least reduce the emission of amplitude-modulated (AM) signals. In contrast within the EP 1 104 645 B1 a solution is presented which is implemented direct within the hearing device. This solution changes the system clock frequency of the hearing device, what is not aspired within the present invention.

The increasing tightening of requirements in relation to interference resistance lead to increasing expensive filter structures on the integrated circuit (IC) as well as on the PCBs (Printed Circuit Boards). In particular the requirement to be able to telephone with a mobile phone while the hearing device is switched on involves great difficulties. The strong transmitter of a mobile phone for instance according to the GSM standard uses a time multiplex (Time Division Multiple Access, TDMA) pattern with a frame rate of approximately 213 Hz and a duty-cycle of the frames of ⅛, ⅔ or ⅘ according to the used protocol.

With the term duty-cycle that temporal portion of the frame rate is understood during which a significant interference energy is radiating onto the hearing device. This amplitude modulation of the emitting capacity which is generated by switching on and off of the emitting signal is absorbed by lacings and conducting paths on the circuit plate within the hearing device and launched into the hearing device at different locations. Especially severe are the launched signals near by the microphone as at this location on one side the signals are very small and on the other side the subsequent amplification is very high. Filter structures with Ferrite-Bead or RC-(Resistor-Capacitor) filters on the various ICs, Hybrids or PCBs are expensive and lead to a large circuit.

It is therefore an object of the present invention to at least partially eliminate or prevent respectively the launching of the mentioned interfering signals to hearing devices.

According to the present invention the object is solved by means of a process according to the wording of claim 1 or an arrangement according to the wording or claim 11 respectively.

According to the invention instead of filtering the interfering signal within the high frequency range its demodulation is accepted by non-linearities and that the interference signal components are only removed in the base band. Instead within the digital range of the signal processing a detector is incorporated by means of which signals with known repetition frequency as well as eventually with known duty cycle can be detected. For instance it can be a detector for GSM-signals. If it detects the typical frequency pattern as for instance the GSM-frequency pattern then it activates a special filter, which removes at least partially the interference signal.

The detection of signals as for instance the GSM-signals happens for instance via the duty-cycle and the ground frequency of the interfering signal. If for instance a pulsing signal with a duty cycle of ⅛, ⅔ or ⅘ with a base frequency of approx. 213 Hz is present, then it can be assumed that it is a GSM-signal. With other words if at a time the point of time of the interference signal is well known, so it can be worked directly within the respective known time range and the respective sampling value can be damped dynamically in an appropriate way. This means, if a first pulse package with respective cycle duration and duty cycle is detected, so the assumption probability of signals with known frequency as for instance of GSM signals will be increased and after a further periodical duration preventively the signal at a preferably exact point of time of the expected next pulses will be eliminated by a certain value.

If by the detector effectively a further pulse at this point of time is detected, so the assumption probability will increase and at the point of time of the again next pulse a stronger suppression can be applied. In such a way a preferable compromise between needless dynamic signal reduction and optimal interference noise suppression as for instance GSM interference noise suppression can be achieved. After some such detected pulses the assumption probability will increase to almost 100%. In such a manner these suppression at the respective point of time of the expected next pulse as for instance the GSM pulse will be achieved in a maximal manner. If finally no pulses shall be detected anymore, the dynamic signal suppression shall be reduced quickly onto zero.

The dynamic suppression of signals is such, that shortly before the expected next pulse the audio signal shall be reduced preferably softly which means not from one detected value to the next one, but by the chosen suppression as for instance 20 dB within preferably some milliseconds (0.5-10 ms), in case of a GSM signal within the amplitude. After a sufficient point of time after the pulse as again for instance the GSM pulse the amplification of the signal shall be increased again preferably smoothly onto the original amplification.

This suppression of the interference pulse as proposed according to the present invention is possible in particular as it could have been shown, that such dynamic signal suppressions are not recognisable psycho-acoustically at speech signals within few milliseconds as described above, as the human brain fills up signal openings in an appropriate way, which means from the existing signal extrapolating in backward and in forward direction. Within the signal opening the interfering pulse existing in this gap as for instance the GSM interference pulse will be suppressed effectively and therefore can not be recognised.

Figure 2:
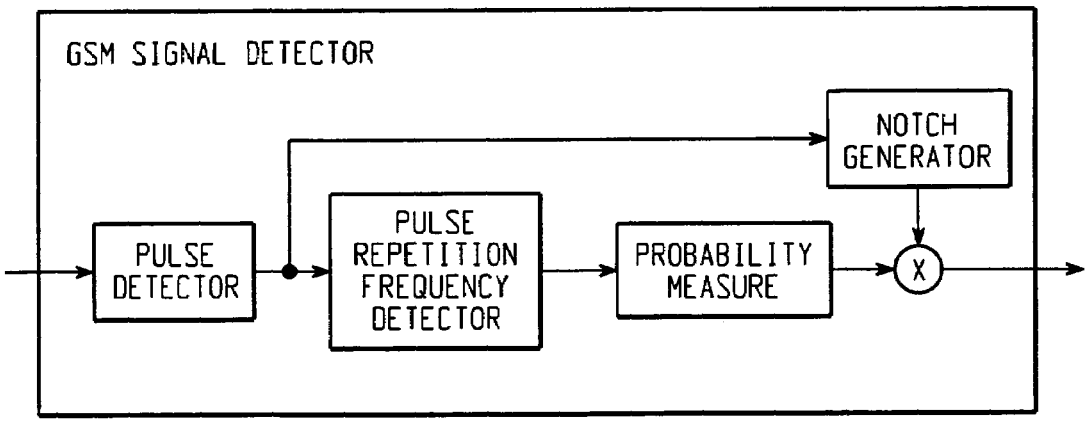
Figure 3:
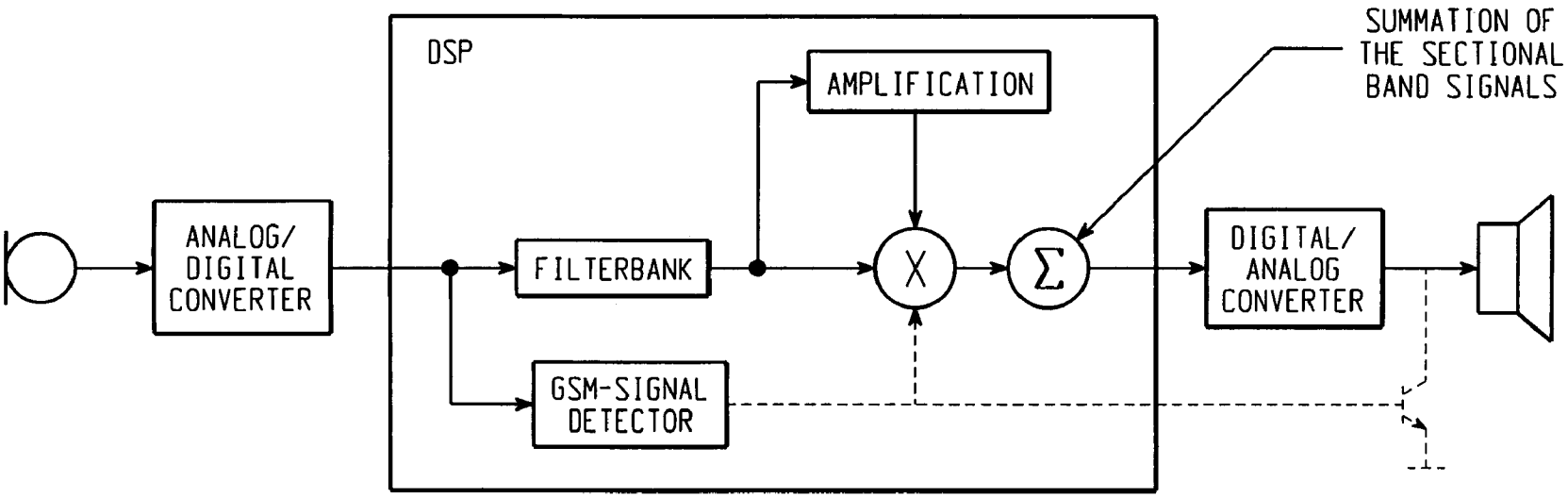

By use of the attached figures the principal of the present invention shall be shortly explained. In the figures:

FIG. 1 shows the exemplary time response of an interference pulse as for instance a GSM pulse FIG. 2 shows a simplified block diagram of a GSM signal detector and FIG. 3 shows a simplified block diagram of a hearing device with a GSM signal detector, which either influences the amplification within the DSP or alternatively direct onto the analogue output signal.

In the attached FIG. 1 schematically an interfering pulse as for instance a GSM pulse is shown. By use of the known detected pulse repetition frequency as well as the duty cycles it can be decided when the amplification of the original signals (original gain) has to be reduced to suppress the interference pulse. By doing so the reduction of the original signal as shown in FIG. 1 is not effected abrupt, but smoothly and accordingly the increase of the amplification again happens smoothly. The gap of the original signal originated by the dynamic signal suppression within the millisecond range as mentioned above is not recognisable by the human brain as the human brain fills up the signal opening or signal gap in an appropriate way, so that no break of the original signal is recognisable.

In FIG. 2 by using a simplified block diagram a GSM signal detector is shown. As already described earlier a signal is detected whereas first it is recognised, whether it is a GSM signal. If a known interference signal is present a further pulse at the next expected point of time is detected and if indeed a further pulse occurs at this point of time the assumpion probability increases that indeed a corresponding interfering pulse is present. Now the suppression of the interfering pulse can be activated as described above with reference to FIG. 1.

As amendment to the above mentioned procedures further procedures are imaginable in the frequency range:

The interference pulse such as for instance GSM interference pulse contain after the demodulation by parasitique non linearities a characteristic spectrum. The amplification within the respective frequency ranges, which are especially effected by the interference signal, shall be decreased against the less intensibly affected ranges again dynamically and smoothly by few DBs, so as to be increased again correspondingly to the original amplification after the pulse.

Instead of processing within the frequency range of course also an adjusted filter within the time range is imaginable which is conducting a spectral formed suppression during the time period of the interference pulse as for instance the GSM interference pulse.

Although the above mentioned procedures and proposals are mentioned specifically in connection to GSM interference pulses it has to be pointed out, that the proposed process or the inventive measures correspondingly can also be used for other interference pulses. An assumption is of course that the interference pulses occur with known equally remaining repetition frequency and that also preferably the duty cycle is known. In particular the inventive proposed process can also be applied to other mobile telephone standards as for instance the CDMA standard, used in northern America, which produces a different kind of interferences. This means with the aid of a suitable detector the presence of characteristic interference noises or interference signals shall be detected and afterwards shall be filtered dynamically out of the audio signal by the use of an appropriate filter in relation to time and spectrum. Furthermore it has to be mentioned, that the knowledge of the repetition frequency also can be determined only during the operation of the hearing device, which means shall be detected based upon a signal analysis, that a certain pulse repetition pattern does not belong to a required signal but to an interference signal and correspondingly should be removed such so that the inference is not recognisable anymore. Filtering out of the interference pulse can be executed within the hearing device as schematically shown in FIG. 3 within the digital signal processing area by use of digital filters as well as by means of analogue filters which are for instance arranged between the digital signal processing (DSP) or Digital/Analogue Converter (DAC) respectively and the loudspeaker. FIG. 3 shows a simplified block diagram of a hearing device with a GSM signal detector, which influenced either onto the amplification within the DSP or alternatively direct onto the analogue output signal (ADC stands for analogue/digital converter).

It has to be pointed out, that interferences within the microphone pad as well as for instance in an analogue or digital wire-bounded or wireless transmission path between two hearing devices or a hearing device and a further device can be feed into to the hearing device system and the described procedures are applicable independent from the feeding point.

The proposed invention represents a preferred embodiment to increase the interference resistance of hearing devices. It is of course possible that the proposed measures alone are not sufficient but it is for instance possible in combination with other typical measures as for instance Ferrite-Beads, RC-Filters etc. to achieve an additional interference suppression.

The invention claimed is:

1. An apparatus for suppressing an intermittent interference signal occurring during use of a hearing device, comprising:

a detector for detecting a repetition rate and a duty-cycle of an intermittent interference signal having an approximately-known repetition rate and an approximately-known duty-cycle; and an automatically adjustable volume control which is functionally coupled to said detector in a feed-forward configuration.

2. The apparatus according to claim 1 where the detector and the automatically adjustable volume control are located in a digital section of the hearing device.

3. The apparatus according to claim 1 where an automatically adjustable analog volume control is located in the section before the loudspeaker of the hearing device.

4. The apparatus according to claim 1, where said automatically adjustable volume control only acts upon an output signal within a limited frequency range, where the spectral content of said intermittent interference signal is essentially confined to said limited frequency range.

5. A method of suppressing an intermittent interference signal occurring during use of a hearing device, the method comprising the steps of:

detecting the repetition rate and duty-cycle of an intermittent interference signal having an approximately-known repetition rate and an approximately-known duty-cycle within the hearing device; and upon detecting the presence of said intermittent interference signal and determining the repetition rate and duty-cycle of said intermittent interference signal, attenuating an output signal of the hearing device at least at an expected next point in time of recurrence of the said intermittent interference signal, where said attenuation is achieved by an automatically adjustable volume control acting on said output signal, and where said detection is at least based upon a signal derived from a point on the audio signal path located before the point where said attenuation is applied.

6. The method according to claim 5 where detecting the repetition rate and duty-cycle of an intermittent interference signal is performed during each period of the intermittent interference signal.

7. The method according to claim 5 where the detection step is performed using digital circuitry within the hearing device.

8. The method according to claim 5 where the decision if a regularly repeating signal pattern represents an intermittent interference signal is performed during the operation of the hearing device.

9. The method according to claim 5 where upon each new instance of detecting the presence of said intermittent interference signal having an approximately-known repetition rate and an approximately-known duty-cycle, the amount of attenuation by which an output signal of a hearing device is attenuated, at least at an expected next point in time of recurrence of the intermittent interference signal, is increased.

10. The method according to claim 5 where attenuation of an output signal of the hearing device is performed using digital circuitry within the hearing device.

11. The method according to claim 5 where attenuation of an output signal of the hearing device is performed using analog circuitry within the hearing device for instance in the section between a digital-to-analog converter and the loudspeaker.

12. The method according to claim 5 where the duration of output signal attenuation, with an attenuation value greater than 0 dB, is very short, for instance on the order of milliseconds.

13. Use of the method according to claim 5 for suppressing the intermittent interference signal as it may occur when the hearing device is exposed to radio transmission signals according to mobile telephone standards such as for instance the GSM or CDMA standard.

14. The method according to claim 5 where the attenuation of said output signal of the hearing device increases smoothly from 0 dB to a maximum value around an expected next point in time of recurrence of the intermittent interference signal and subsequently decreases again smoothly from said maximum value back to 0 dB around the end of the active part of the duty-cycle of said intermittent interference signal.

15. The method according to claim 5 where upon not detecting the presence of said intermittent interference signal having an approximately-known repetition rate and an approximately-known duty-cycle, the amount of attenuation by which said output signal of the hearing aid is attenuated, at least at an expected next point in time of recurrence of the intermittent interference signal, is set to 0 dB.

16. A method of suppressing an intermittent interference signal occurring during use of a hearing device, the method comprising the steps of:

detecting the repetition rate and duty-cycle of an intermittent interference signal having an approximately-known repetition rate and an approximately-known duty-cycle; and upon detecting the presence of such an intermittent interference signal and determining the repetition rate and duty-cycle of said intermittent interference signal, attenuating an output signal of the hearing device at least at an expected next point in time of recurrence of said intermittent interference signal, where said attenuation is achieved by an automatically adjustable volume control acting on said output signal within a limited frequency range, where the spectral content of said intermittent interference signal is essentially confined to said limited frequency range, and where said detection is at least based upon a signal derived from a point on the audio signal path located before the point where said attenuation is applied.

* * * * *